US008408615B1

(12) United States Patent
Patel

(10) Patent No.: US 8,408,615 B1
(45) Date of Patent: Apr. 2, 2013

(54) PICKUP DEVICE FOR ANIMAL WASTE

(75) Inventor: Tony Patel, Naples, FL (US)

(73) Assignee: Tony Patel, Naples, FL (US)

( * ) Notice: Subject to any disclaimer, the term of this patent is extended or adjusted under 35 U.S.C. 154(b) by 0 days.

(21) Appl. No.: 13/267,242

(22) Filed: Oct. 6, 2011

(51) Int. Cl.
*A01K 29/00* (2006.01)

(52) U.S. Cl. ..... 294/1.4

(58) Field of Classification Search ..... 294/1.3–1.5, 294/100, 209; 119/161
See application file for complete search history.

(56) References Cited

U.S. PATENT DOCUMENTS 4,056,278 A * 11/1977 Bau et al. ..... 294/1.4
4,078,838 A * 3/1978 Nadratowski ..... 294/1.4
4,097,082 A 6/1978 Orofino
4,200,319 A * 4/1980 Cooper ..... 294/1.4
5,380,054 A * 1/1995 Galvis ..... 294/1.4
5,628,537 A 5/1997 Kiemer
5,702,137 A * 12/1997 Gutierrez ..... 294/1.4
6,196,601 B1 * 3/2001 Juntunen, Jr. ..... 294/1.4
6,305,322 B1 10/2001 Patel
2008/0042456 A1 2/2008 Patel
2010/0084881 A1 * 4/2010 Patel ..... 294/1.4

* cited by examiner

*Primary Examiner* — Dean Kramer

(57) ABSTRACT

An animal waste pickup device that has a handle, an elongate member and an upper pair of operating arms and a lower pair of operating arms located at the lower end of the elongate member. A fibrous material attaches to spiked material underlying the upper pair of arms. The upper arms are hingedly raised and lowered where the hinge connection is at the bottom of the elongate member. The lower pair of arms is configured to clamp together along a generally central point and the lower pair of arms further has spaced-apart apertures that are aligned to correspond with the spiked material such that the spiked material protrudes through the apertures a sufficient distance to engage the fibrous material. The lower pair of arms is operable using a grip trigger at the handle area that is in mechanical communication with the lower arms.

4 Claims, 3 Drawing Sheets

PICKUP DEVICE FOR ANIMAL WASTE

FIELD OF THE INVENTION

The invention relates to an animal waste pickup device having a long handle carried by an animal handler so that any animal droppings do not have to be manually handled.

BACKGROUND OF THE INVENTION

The invention pertains to an animal waste pickup device that can be used in an easy procedure and in a completely sanitary manner. Pet owners and other observers are quite familiar with city, county, and other local ordinances that require pet owners, who take their pets for walks, to pick up the pet's or animal's droppings such as feces to keep the environment in a sanitary condition. This ordinance, including common sense, applies to public properties as well as private properties. With the increased public concern over sanitation and a cleaner environment, many municipalities have required that dog owners clean up after the animals have defecated on public properties. Although this is more pleasant for the public, it leaves the dog owner with an extremely unpleasant task. Many different scooping devices have been provided to hold open a bag while the feces are scraped or scooped therein. Various devices are known to accomplish the above mandate. It is known to use plastic gloves that are worn on a hand which simply pick up the droppings and by inverting the glove or by simply stripping the glove off the hand to invert the same, the dropping can be disposed of in a sanitary manner. Others simply carry a small bucket or similar container to accomplish the same task as noted above. Then there are other more complicated devices which accomplish the pick up and disposal of animal droppings in a completely sanitary manner.

U.S. Pat. No. 4,097,082 to Orofino describes a device which accomplishes the above noted task. The implement described in this patent consists of an elastomeric band to automatically close over the mouth of a flexible wrapper which is operated by two side plates that will swing inwardly at their bottom to thereby grab the flexible wrapper having the animal dropping therein, to keep it therein and to thereafter dispose of the same, all in a sanitary manner.

U.S. Pat. No. 5,628,537 to Kiemer shows a similar device. This patent discloses a device which also uses a pair of jaws that are pivotally attached to one end of a long handle. An elongate sleeve is connected to the jaws around the handle. When the jaws are locked open, a bag clip engages the closed end of an ordinary thin plastic bag while the open end of the bag is inverted over the edges of the jaws. To pick up the dog feces, the user positions the bag over the waste, makes the jaws to contact with the ground, rotates the sleeve to unlock a sliding motion and moves the sleeve downward on the handle. This closes the jaws and encloses the waste within the bag to be disposed of at a later time and in a sanitary manner.

U.S. Pat. No. 6,305,322 to Patel (the inventor herein) discloses a waste pickup device with a cross of flexible material at one end of a handle. The cross with claws thereon will accept a sheet of paper. When the device is used to pick up animal droppings, the cross with its claws is placed over the animal waste and then the cross is pulled back into a sleeve at the lower end of a handle and as the cross collapses into the sleeve, the waste is picked up and disappears into the sleeve to be disposed of.

U.S. Patent Publication 2008/0042456 publishes an application by Patel (the inventor herein). This disclosure describes a device which comprises a handle having triggers at the upper end of the handle to operate elements at the lower end of the handle. The elements at the lower end consist of a pair of outer clam shells which are opened or closed from the triggers at the upper end. The outer clam shells have located therein a second pair of claim shells having central openings therein. The second pair of clam shells is always biased into an open position and is operated in conjunction with the operation of the first or outer clam shells. The second pair is rotated within the first pair by an electric motor to twist a paper bag into a pile once the pet waste has been trapped therein.

SUMMARY OF THE INVENTION

The present invention is a device for picking up animal waste droppings or feces. The device comprises an elongate member with a preferred handle at its upper end. The elongate member length is typically of sufficient length so that a user can manipulate the device and pick-up animal waste without having to overly exert himself or herself by having to bend down and reach the ground surface. The elongate member can be formed as a tube with a hollow interior.

The invention further includes an upper pair of operating arms and a lower pair of operating arms located at the lower end of the elongate member. Each of the upper and lower pairs of operating arms has a width and length dimension and is generally planar in form. A fibrous material, which is generally planar shaped and having a predetermined width and length underlies the lower pair of arms but is attachable to the upper pair of arms by clinging to spiked material that is fixed to the upper arms but protrudes through apertures in the lower pair of arms. The spiked material is typically material such as those used on Swifter® cleaning/dusting products or hook and loop type of material.

The upper pair of operating arms include articulation means for hingedly raising and lowering the upper pair of operating arms at a lower end of the elongate member. The lower pair of operating arms is configured to clamp together along a generally central point. As mentioned above, the lower pair of operating arms has spaced-apart apertures that are aligned to correspond with the spiked material such that the spiked material protrudes through the apertures a sufficient distance to engage the fibrous material. The fibrous material being releasably engaged to the spiked material such that the fibrous material clings to the spiked material until it is released for disposal with an animal waste content.

The invention includes means for operating the lower pair of operating arms at the lower end of the elongate member. One example of providing this functional feature, but not limited to such example, is by providing a grip trigger located at the upper end of the elongate member. The grip trigger is in mechanical communication with the generally central point of the lower pair of operating arms. When the grip trigger is activated such as by pulling the grip trigger in an upward direction, the lower pair of operating arms are clamped together to capture the animal waste contained within the fibrous material or when the grip trigger is activated by pushing the grip trigger in a downward direction, the lower pair of operating arms are opened in a generally planar orientation for placement over the animal waste to be collected.

Preferably to enhance the grasping characteristics of the invention, the lower pair of operating arms can be configured to include a plurality of teeth located at opposing ends of the lower pair of operating arms. The teeth are generally oriented perpendicularly to the plane of the lower pair of operating arms.

A handle may also be included at the upper end of the elongate member and the grip trigger may be incorporated at the upper end of the elongate member so as to be easily manipulated while still holding on to the handle.

Animal waste is picked up by placing the fibrous material over the animal waste to be picked up. The dimensions of the fibrous material is preferably greater than that of the lower flat arms. The device is place over it with the lower arms in an open orientation and the spiked material protruding through the apertures of the lower arms picks up the fibrous material. Upon closing the lower arms, the device effectively claws or grasps the animal waste, which gets smeared or mashed against the fibrous material still adhering to the spikes. After the picking process is all done, the grip trigger can be operated to open the lower arms together with the upper arms to dislodge the soiled fibrous material with its waste content for proper disposal.

DETAILED DESCRIPTION OF THE INVENTION

Figures 1, 2:
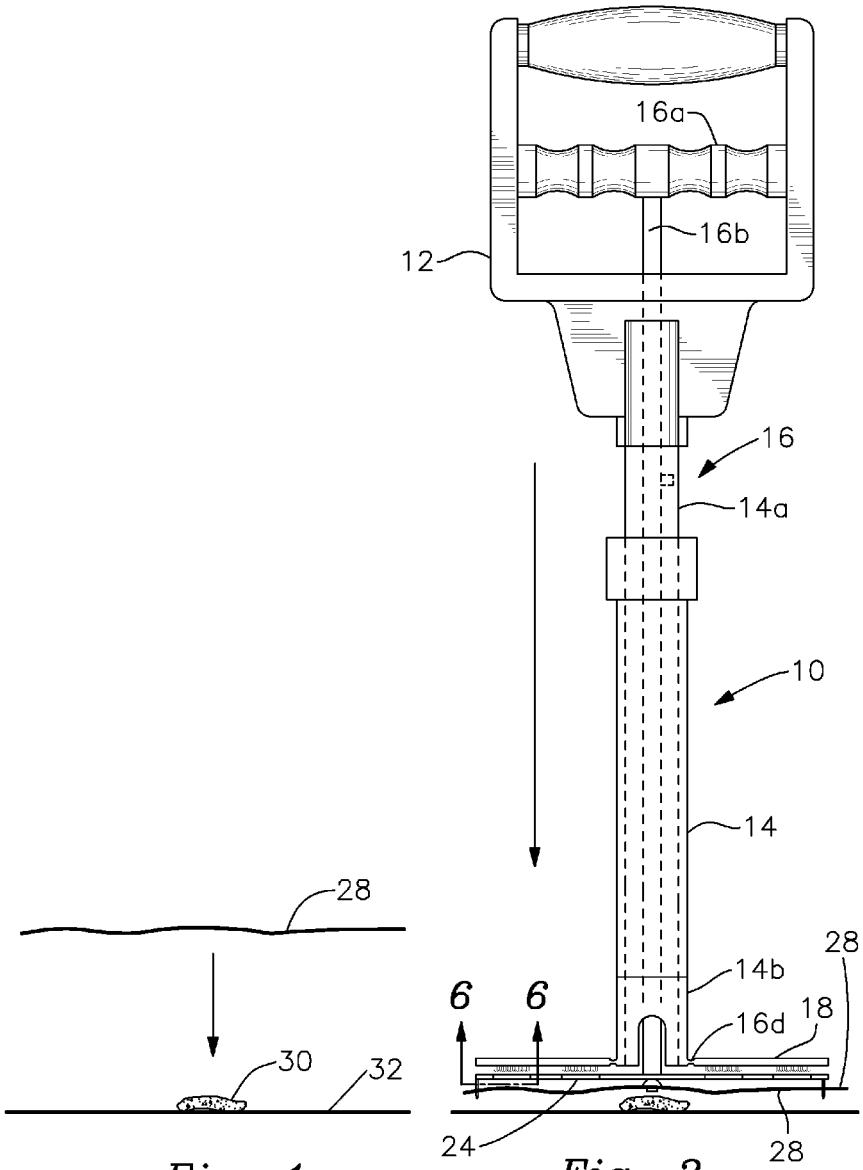
FIG. 1 is a conceptual depiction of a fecal waste on a ground surface with an overlying fibrous material about to come in contact with the waste.
FIG. 2 is a conceptual depiction of an example of one embodiment of the present invention with the invention positioned to begin securing the waste matter within the fibrous material by using a clamping motion.
Figure 3:
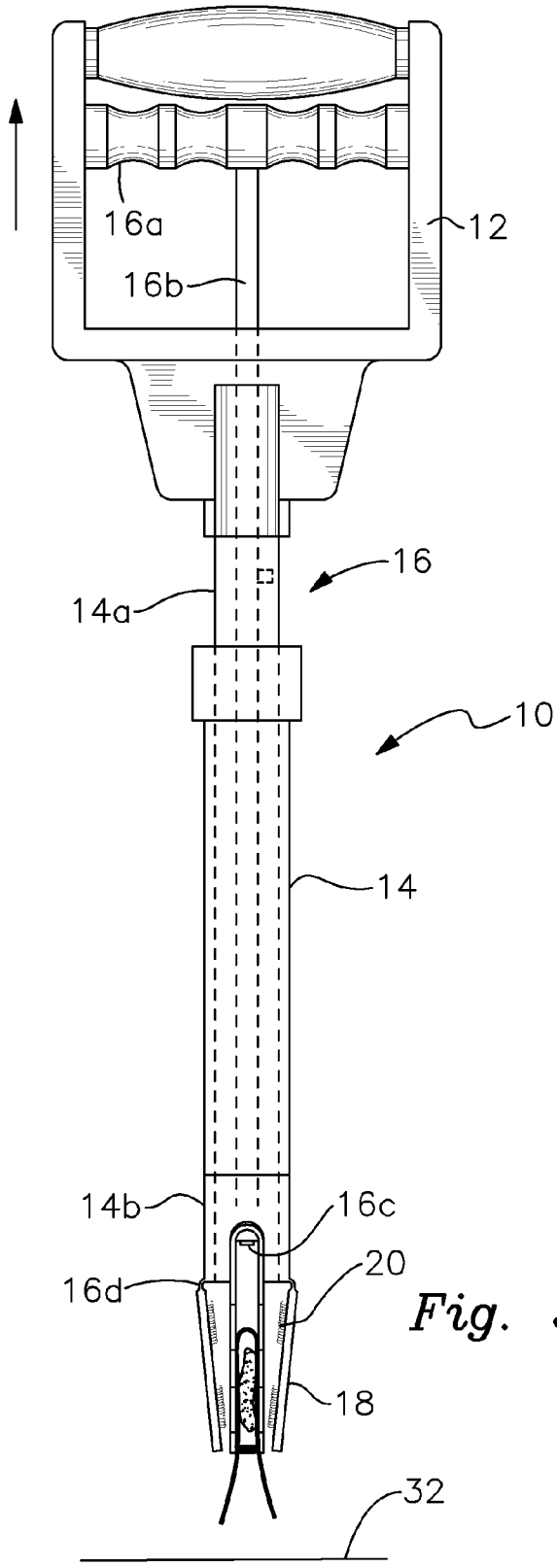
FIG. 3 is a depiction of the invention of FIG. 2 wherein the waste matter has been clamped and secured within the fibrous material.
Figure 4:
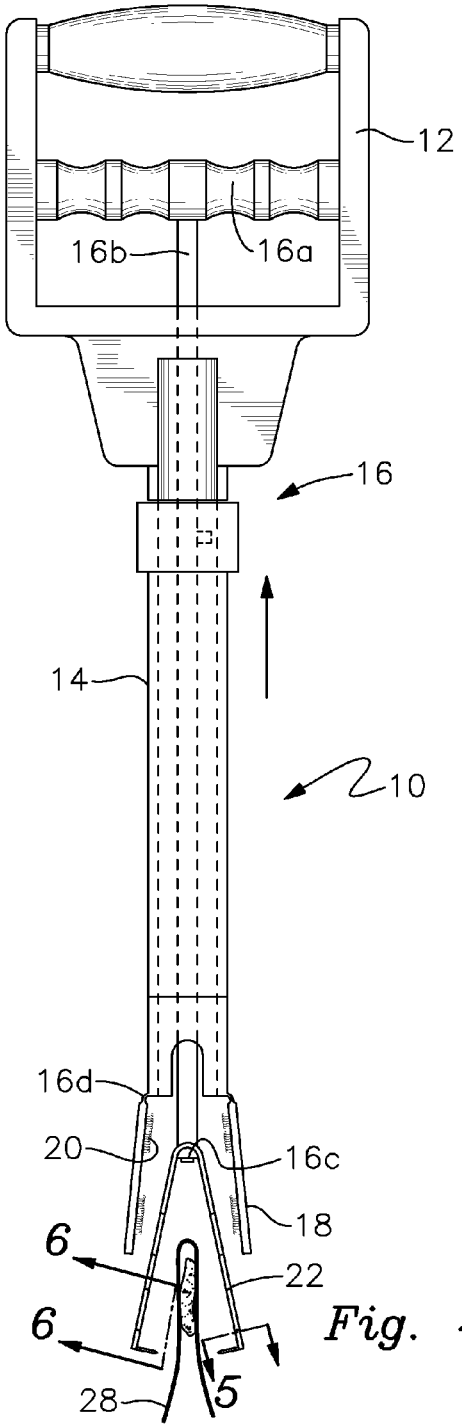
FIG. 4 is a depiction of the present invention where the fibrous material is being separated from the invention for proper disposal of the waste matter content.

Referring now to the drawings, FIGS. 1-6 disclose conceptual views of one example of the present invention, which is an animal waste pick-up device, depicted generally as 10.

The device 10 is intended to pick up animal waste 30 from the ground surface 32. The device 10 comprises an elongate member 14 with a preferred handle 12 at its upper end 14*a*. The elongate member 14 length is typically of sufficient length so that a user can manipulate the device 10 and pick-up animal waste 30 without having to overly exert himself or herself by having to bend down and reach the ground surface 32. The elongate member 14 can be formed as a tube with a hollow interior or as a solid form.

The invention further includes an upper pair of operating arms 18 and a lower pair of operating arms 22 located at the lower end of the elongate member 14. Each of the upper and lower pairs of operating arms 18,22 has a width and length dimension and is generally planar in form. A fibrous material 28, which is generally planar shaped and having a predetermined width and length underlies the lower pair of arms 22 but is attachable to the upper pair of arms 18 by clinging to spiked material 20 that is fixed to the upper arms 18 but protrudes through spaced-apart apertures 24 in the lower pair of arms 22. That is, the footprint of the spiked material 20 is such that when the upper and lower arms 18,22 are in the open position, the spiked material 20 aligns and protrudes within the boundaries of the apertures 24 of the lower arms 22. The spiked material 20 can be made from a variety of materials commercially available; however, material such as those used on Swifter® cleaning/dusting products or hook and loop type of material will work very well. The spiked material 20 can be adhesively attached to the underside of the upper arms 18 at predetermined locations.

The upper pair of operating arms 18 include articulation means 16*d* for hingedly raising and lowering the upper pair of operating arms 18 at a lower end 14*b* of the elongate member 14. Essentially, the upper arms 18 are each mechanically connected to the housing lower end 14*b* so as to flex or hinge up and down at 16*d*. The upper arms 18 essentially follow the up and down motion of the lower arms 22, which are manipulated using the grip trigger 16*a* further described below.

The lower pair of operating arms 22 is configured to clamp together along a generally central point at 16*c*. As mentioned above, the lower pair of operating arms 22 has spaced-apart apertures 24 that are aligned to correspond with the spiked material 20 such that the spiked material 20 protrudes through the apertures 24 a sufficient distance to engage the fibrous material 28. The fibrous material 28 is releasably engaged to the spiked material 20 such that the fibrous material 28 clings to the spiked material 20 until it is released for disposal with its animal waste contents.

The invention includes means 16 for operating the lower pair of operating arms 22 at the lower end 14*b* of the elongate member 14. One example of providing this functional feature, but not limited to such example, is by providing a grip trigger 16*a* located at the upper end of the elongate member 14. The grip trigger 16*a* is in mechanical communication with the generally central point 16*c* of the lower pair of operating arms 22. The mechanical communication can be a spring loaded rod 16*b* that provides for adequate linkage to connect the grip trigger 16*a* with the lower arms 22 at 16*c*. When the grip trigger 16*a* is activated such as by pulling the grip trigger 16*a* in an upward direction, the lower pair of operating arms 22 are clamped together to capture the animal waste 30 contained within the fibrous material 28 or when the grip trigger 16*a* is activated by pushing the grip trigger 16*a* in a downward direction, the lower pair of operating arms 22 are opened in a generally planar orientation for placement over the animal waste 30 to be collected.

Figure 5:
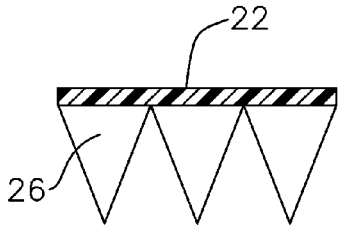
FIG. 5 is a sectional depiction emphasizing the claws or teeth on the lower arms for grasping and clamping the waste matter.
Figure 6:
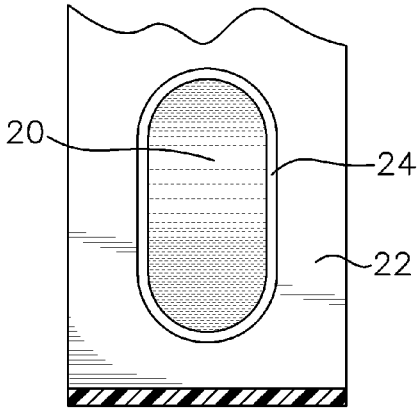
FIG. 6 is a partial depiction of the spikes or hook and loop material protruding through apertures of the lower flat arms of the invention.

Preferably to enhance the grasping characteristics of the invention, the lower pair of operating arms 22 can be configured to include a plurality of teeth 26 located at opposing ends of the lower pair of operating arms 22. The teeth 26 are generally oriented perpendicularly to the plane of the lower pair of operating arms 22. The teeth may be formed as triangular shaped teeth as shown in FIG. 5 or in other shapes that enhance the clasping and grabbing action. They may be spaced-apart along the edge as opposed to contiguous as depicted in FIG. 5.

A handle 12 may also be included at the upper end 14*a* of the elongate member 14 and the grip trigger 16*a* may be incorporated at the upper end 14*a* of the elongate member 14 so as to be easily manipulated while still holding on to the handle 12.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. An animal waste pickup device comprising:

an elongate member having an upper and a lower end;

an upper pair of operating arms and a lower pair of operating arms located at the lower end of the elongate member, each of the upper and lower pairs of operating arms having a width and length dimension and is generally planar in form;

a fibrous material generally planar shaped having a predetermined width and length;

the upper pair of operating arms having articulation means for hingedly raising and lowering the upper pair of operating arms, the articulation means being located at a lower end of the elongate member;

the upper pair of operating arms further having spaced-apart spiked material on an underside of the upper pair of operating arms for engagement with the fibrous material;

the lower pair of operating arms being configured to clamp together along a generally central point, the lower pair of operating arms further having spaced-apart apertures that are aligned to correspond with the spiked material such that the spiked material protrudes through the apertures a sufficient distance to engage the fibrous material;

means for operating the lower pair of operating arms at a lower end of the elongate member; and the fibrous material being releasably engaged to the spiked material such that the fibrous material clings to the spiked material until it is released for disposal with an animal waste content.

2. The device according to claim 1, wherein the means for operating the lower pair of operating arms at a lower end of the elongate member comprises a grip trigger located at the upper end of the elongate member, the grip trigger being in mechanical communication with the lower pair of operating arms at the generally central point wherein when the grip trigger is activated, the lower pair of operating arms are selectively clamped together to capture the animal waste contained within the fibrous material or opened in a generally planar orientation for placement over the animal waste to be collected.

3. The device according to claim 1, wherein the lower pair of operating arms further comprises a plurality of teeth located at opposing ends of the lower pair of operating arms, the plurality of teeth being generally oriented perpendicularly to the lower pair of operating arms.

4. The device according to claim 1, further comprising:

a handle at an upper end of the elongate member.

* * * * *